US007124612B2

(12) United States Patent
Le Guevel

(10) Patent No.: US 7,124,612 B2
(45) Date of Patent: Oct. 24, 2006

(54) CRIMPING BLADE PROFILE

(75) Inventor: Gabriel Le Guevel, Chavagne (FR)

(73) Assignee: Process Conception Ingenierie, Meudon (FR)

( * ) Notice: Subject to any disclaimer, the term of this patent is extended or adjusted under 35 U.S.C. 154(b) by 0 days.

(21) Appl. No.: 10/496,113

(22) PCT Filed: Apr. 14, 2003

(86) PCT No.: PCT/FR03/01187

§ 371 (c)(1),
(2), (4) Date: May 19, 2004

(87) PCT Pub. No.: WO03/086678

PCT Pub. Date: Oct. 23, 2003

(65) Prior Publication Data

US 2005/0050934 A1 Mar. 10, 2005

(30) Foreign Application Priority Data

Apr. 15, 2002 (FR) ..... 02 04686

(51) Int. Cl.
*B21D 39/02* (2006.01)

(52) U.S. Cl. ..... 72/312; 29/243.58

(58) Field of Classification Search ..... 72/312–315, 72/319, 386, 388; 29/243.58, 243.57
See application file for complete search history.

(56) References Cited

U.S. PATENT DOCUMENTS

| | | | | |
|---|---|---|---|---|
| 2,707,510 A | | 5/1955 | Gershon | |
| RE31,938 E | * | 7/1985 | Klukow | 72/387 |
| 4,557,132 A | * | 12/1985 | Break | 72/319 |
| 4,606,213 A | * | 8/1986 | Persson | 72/300 |
| 6,000,118 A | | 12/1999 | Biernat et al. | |
| 6,739,169 B1 | * | 5/2004 | Baulier | 72/312 |

FOREIGN PATENT DOCUMENTS

| | | | |
|---|---|---|---|
| EP | 1 068 910 | | 1/2001 |
| JP | 7-9040 | * | 1/1995 |
| JP | 7-88567 | * | 1/1995 |
| WO | WO 01/00918 | | 1/2001 |

* cited by examiner

*Primary Examiner*—Daniel C. Crane
(74) *Attorney, Agent, or Firm*—Nicolas E. Seckel

(57) ABSTRACT

The invention relates to a crimping blade with a profile such that the angle of attack β of the sheet metal to be crimped remains constant during the entire crimping phase. In this way, the force applied to the sheet metal is always at the same angle in relation to the sheet metal.

23 Claims, 2 Drawing Sheets

CRIMPING BLADE PROFILE

The invention concerns crimping tools and more particularly the pre-crimping blade that equips said tools. The crimping system comprises a matrix on which is placed the metal sheet(s) to be crimped, a pre-crimping blade and a crimping blade that come successively to push on the edge of the metal sheet so as to raise it and fold it down.

There are several types of crimping:

"flat" crimping,

"water drop" crimping, which is characterized by the fold of the crimped metal sheet having the shape of a "water drop".

Flat crimping is a crimping operation whereby the part to be crimped is folded flat.

Water drop crimping is advantageous to reinforce the edge of the part, by creating a shape of a tube having a high inertia. It makes it possible to manufacture parts, such as the front or the rear of car hoods, whose profile is visible by the conductor. The hoods must indeed be the least aggressive possible in the case of an accident.

Blade profiles at 45° and radial blade profiles are known, but these types of blades do not allow a perfect mastering of the crimping operation and present a risk that the blade may be raised from the matrix. This phenomenon generates a defect of double line, if the elastic limit is exceeded, which is unaesthetic.

The object of the present invention is to propose a pre-crimping blade which makes it possible to perform a pre-crimping with metal sheets forming an opening angle more important, beyond 107°, and to master the folding radius of the metal sheet during the pre-crimping phase.

If the angle of attack β is defined as the angle formed by the edge of the blade and the tangent to the blade profile.

The pre-crimping blade according to the invention has a profile such that the angle of attack β of the metal sheet to be crimped remains constant during the whole pre-crimping phase. Thus, the force applied to the metal sheet has always the same angle relative to the metal sheet.

The blade profile according to the invention is calculated by the following formula (1):

$$yn = L + \sum_{0}^{n} \frac{\begin{array}{c} R[-\cos(\theta n) - \sin(\theta n) + \cos(\theta n - 1) + \sin(\theta n - 1)] + \\ L[\sin\theta n) - \sin(\theta n - 1)] + \\ Rm[-\theta n \cdot \sin(\theta n) + \theta n - 1 \cdot \sin(\theta n - 1)] \end{array}}{\tan(\beta + \theta n - 1)}$$

where R is the outer crimping radius.

e is the thickness of the metal sheet to be crimped.

Rm=R−e/2

θ is the folding angle of the metal sheet, θn are the various angle values taken by the edge of the metal sheet between the start of the pre-crimping operation and the end of the crimping operation, i.e., between 0 and the opening angle of the metal sheet, thus, for example, π/2 is the metal sheet is open at 90°. If α, the value of the opening angle at the start, is above 90°, θn will vary between π/2-α and α.

β is the angle of attack of the metal sheet, i.e., the angle formed by the edge of the metal sheet and the tangent to the crimping blade at the point of contact of the latter with the outer edge of the metal sheet.

L is the height of the edge to be crimped.

According to another characteristic of the invention, the angle β is comprised between 40° and 60°. In this range of values, the force applied to the metal sheet enables a better folding of the latter over itself.

According to a specific characteristic of the invention, the angle β is about 53°. This angle is the optimum angle that makes it possible to fold the metal sheet without raising it from the matrix.

According to another characteristic of the invention, the blade pushes on the outer point of the edge of the metal sheet. The resulting force from the efforts generated by the blade is concentrated toward the outside of the part to be crimped, thus limiting plastic deformations.

According to a specific characteristic of the invention, the pre-crimping operation is performed on a metal sheet forming an angle open at more than 107°. The difficulty reside in that it is difficult to pre-crimp metal sheets forming an angle of more than 90°, the blade according to the invention makes it possible to perform a pre-crimping operation on metal sheets forming an angle open at more than 107°.

According to another specific characteristic of the invention, the pre-crimping operation is performed on an aluminum sheet. Aluminum is a suppler material than metal sheet and is thus more subject to the double line defect.

The invention will be better understood by reading the following description which is provided as an example only and is made in reference to the annexed drawings in which.

Figure 1:
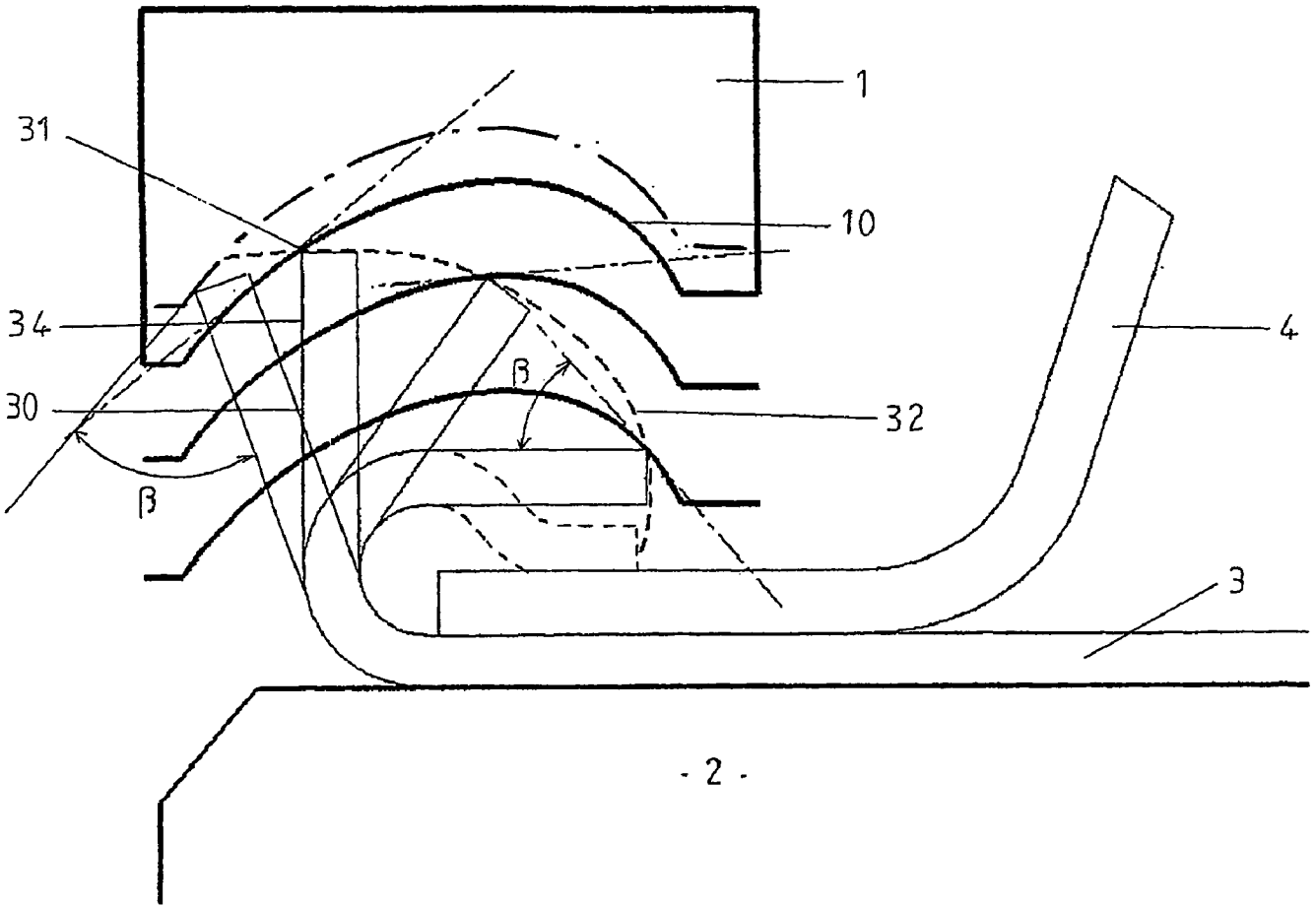
FIG. 1 is a side view of the blade according to the invention.

As is visible on FIG. 1, the pre-crimping blade 1 and the matrix 2 constitute the crimping machine. The metal sheet to be crimped 3 such as a vehicle body skin, is placed on the matrix 2, a second metal sheet 4 such as a double is placed on the metal sheet to be crimped 3.

The pre-crimping blade 1 follows a descending movement to come closer to the matrix 2 and fold the metal sheet 3.

The outer edge 30 of the metal sheet 3 is in contact with the profile 10 of the blade 1. Along with the descending movement of the blade 1 following a trajectory that is rectilinear and substantially perpendicular to the matrix, the edge 30 slides on the profile 10 following a trajectory 32, which performs the folding operation on the metal sheet 3.

As is visible on FIG. 1, the profile 10 of the blade 1 is remarkable in that the plane 34 of the edge 30 always forms an angle β with the tangent to the profile 10 of the blade 1, whichever the position of the edge 30 relative to the blade 1. In this FIGURE, the angle α of the metal sheet 3 at the start is above 90°, but it can also be above 107° up to about 120°.

At the end of the pre-crimping operation, the metal sheet to be crimped 3 is parallel to the matrix 2 and the crimping operation will be performed by a crimping blade which will contact the metal sheet 3 with the metal sheet 4 as is made visible by dotted line on FIG. 1.

Figure 2:
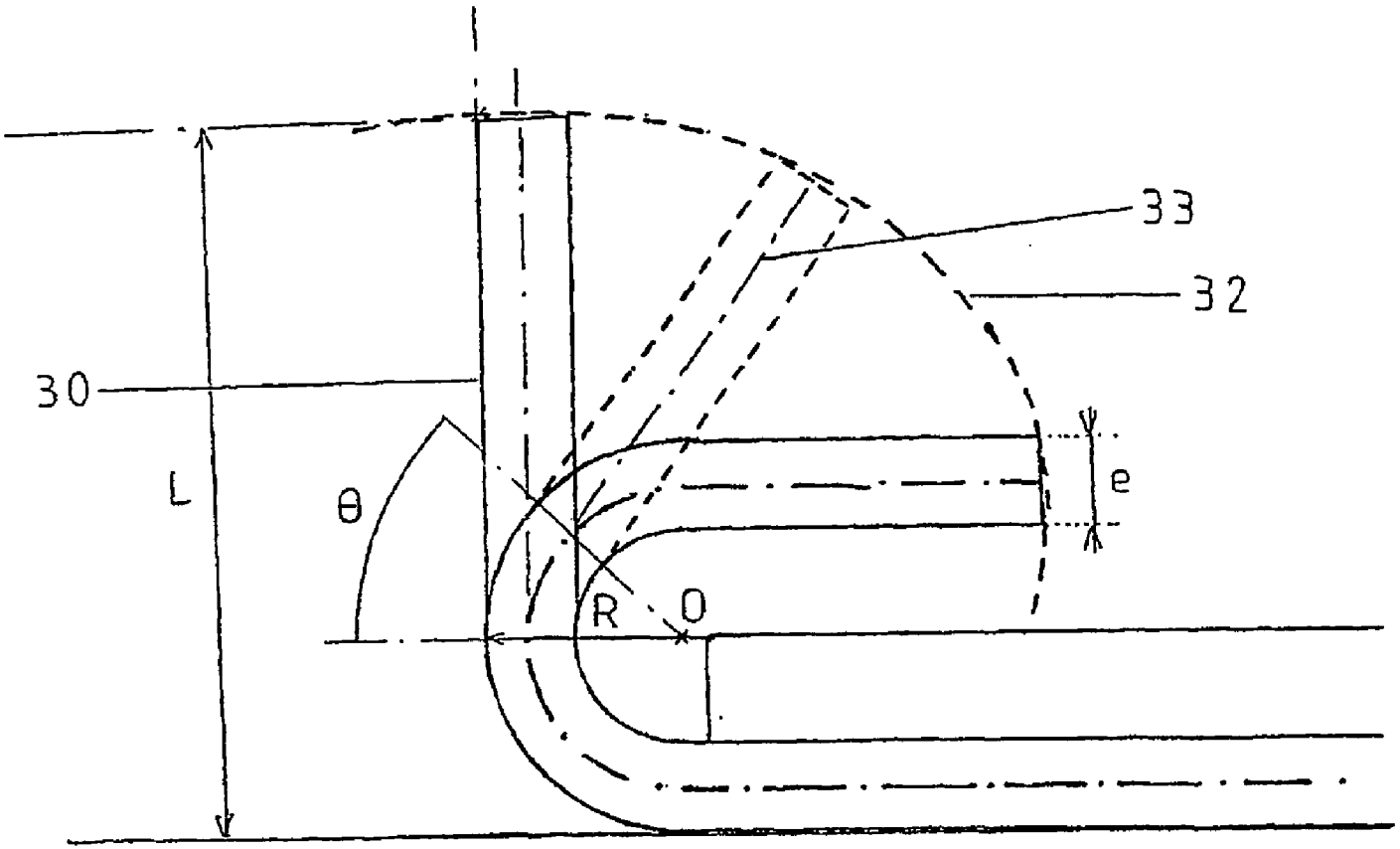
FIG. 2 is a schematic view showing the developed trajectory of the edge of the metal sheet.

FIG. 2 details the various parameters of the trajectory of the edge 30 of the metal sheet 3.

If one considers that the neutral fiber 33 is not subjected to elongation, its trajectory depends on the height of the edge to be crimped L, of a center of rotation O, and of the radius of curvature θ that one wishes to obtain.

Then, to define the trajectory 32 of the edge 30, it is necessary to add the thickness e of the metal sheet as an additional parameter.

The trajectory of the edge 30 of the metal sheet 3 is given by the point having the coordinates (x,y) such that:

$$x=R(1-\cos(\theta))+(L-R-(Rm.\theta)).\sin(\theta)$$

$$y=R.\sin(\theta)+(L-R-(Rm.\theta)).\cos(\theta)+R$$

Once the trajectory 32 has been defined, the profile 10 of the blade 1 is calculated by choosing the angle of attack β relative to the neutral fiber 33 or to the edge 30 as a function of the formula (1) given above. This angle of attack β is selected to be preferably approximately 53°.

The trajectory of the blade 1 is rectilinear perpendicular to the matrix and the resulting force of the efforts generated by the latter is concentrated towards the outside of the part to the crimped 3, thus limiting the plastic deformations.

The profile of the blade thus defined makes it possible to pre-crimp doors as well as hoods, covers, made of steel or aluminum, while simplifying the edge flanging operations.

The invention claimed is:

1. Pre-crimping blade for crimping a metal sheet having a profile wherein the profile is such that an angle of attack β of the metal sheet to be crimped remains constant when the blade pushes on an edge of the metal sheet rectilinearly such that the edge of the metal sheet slides on the profile following a trajectory, which performs a folding operation on the metal sheet, wherein the angle β is comprised between 45° and 60°.

2. Pre-crimping blade according to claim 1 wherein the angle β is about 53°.

3. Pre-crimping blade according to claim 1, wherein the pre-crimping is performed on a metal sheet forming an angle open at more than 107°.

4. Pre-crimping blade according to claim 1, wherein the pre-crimping is performed on an aluminum sheet.

5. Pre-crimping blade according to claim 2, wherein the blade pushes on an outer point of an edge of the metal sheet.

6. Pre-crimping blade according to claim 2, wherein the pre-crimping is performed on a metal sheet forming an angle open at more than 107°.

7. Pre-crimping blade according to claim 2, wherein the pre-crimping is performed on an aluminum sheet. is performed on a metal sheet forming an angle open at more than 107°.

8. Pre-crimping blade according to claim 1, wherein the blade pushes on an edge of the metal sheet perpendicularly to a matrix on which the metal sheet is placed.

9. Pre-crimping blade according to claim 1, wherein the blade pushes on the metal sheet rectilinearly during the whole pre-crimping phase.

10. Pre-crimping blade for crimping a metal sheet having a profile wherein the profile is such that an angle of attack β of the metal sheet to be crimped remains constant when the blade pushes on the metal sheet rectilinearly, wherein the profile of the blade is calculated with the following formula:

$$yn = L + \sum_{0}^{n} \frac{R[-\cos(\theta n) - \sin(\theta n) + \cos(\theta n - 1) + \sin(\theta n - 1)] + L[\sin\theta n) - \sin(\theta n - 1)] + Rm[-\theta n \cdot \sin(\theta n) + \theta n - 1 \cdot \sin(\theta n - 1)]}{\tan(\beta + \theta n - 1)}$$

wherein

R is the outer crimping radius, e is the thickness of the metal sheet to be crimped, Rm=R−e/2, θ is the folding angle of the metal sheet, β is the angle of attack of the metal sheet, and L is the height of the edge to be crimped.

11. Pre-crimping blade according to claim 10, wherein the angle β is comprised between 45° and 60°.

12. Pre-crimping blade according to claim 11, wherein the angle β is about 53°.

13. Pre-crimping blade according to claim 10, wherein the blade pushes on an outer point of an edge of the metal sheet.

14. Pre-crimping blade according to claim 10, wherein the pre-crimping is performed on a metal sheet forming an angle open at more than 107°.

15. Pre-crimping blade according to claim 10, wherein the pre-crimping is performed on an aluminum sheet.

16. Pre-crimping blade for crimping a metal sheet having a profile wherein the profile is such that an angle of attack β of the metal sheet to be crimped remains constant when the blade pushes on an edge of the metal sheet rectilinearly such that the edge of the metal sheet slides on the profile following a trajectory, which performs a folding operation on the metal sheet, wherein the blade pushes on an outer point of an edge of the metal sheet.

17. Pre-crimping blade according to claim 16, wherein the pre-crimping is performed on a metal sheet forming an angle open at more than 107°.

18. Pre-crimping blade according to claim 16, wherein the pre-crimping is performed on an aluminum sheet.

19. Pre-crimping blade for crimping a metal sheet having a profile wherein the profile is such that an angle of attack β of the metal sheet to be crimped remains constant when the blade pushes on an edge of the metal sheet rectilinearly such that the edge of the metal sheet slides on the profile following a trajectory, which performs a folding operation on the metal sheet, wherein the profile of the blade is defined wherein the folding operation is performed on a metal sheet forming an angle of more than 90 degrees before folding to an angle of less than 90 degrees after folding.

20. Pre-crimping blade according to claim 19, wherein the angle β is comprised between 45 and 60.

21. Pre-crimping blade according to claim 19, wherein the blade pushes on an outer point of an edge of the metal sheet.

22. Pre-crimping blade according to claim 19, wherein the pre-crimping is performed on a metal sheet forming an angle open at more than 107°.

23. Pre-crimping blade according to claim 19, wherein the pre-crimping is performed on an aluminum sheet.

* * * * *